United States Patent [19]

Theurer

[11] 4,192,237

[45] Mar. 11, 1980

[54] MOBILE TRACK SURFACING MACHINE

[75] Inventor: Josef Theurer, Vienna, Austria

[73] Assignee: Franz Plasser Bahnbaumaschinen-Industriegesellschaft m.b.H., Vienna, Austria

[21] Appl. No.: 882,666

[22] Filed: Mar. 2, 1978

[30] Foreign Application Priority Data

Mar. 17, 1977 [AT] Austria ..... 1862/77

[51] Int. Cl.[2] ..... E01B 27/17

[52] U.S. Cl. ..... 104/7 B; 104/12

[58] Field of Search ..... 104/2, 7 R, 7 B, 12, 104/8; 105/4 R

[56] References Cited

U.S. PATENT DOCUMENTS

| | | | |
|---|---|---|---|
| 3,469,534 | 9/1969 | Plasser et al. | 104/7 B |
| 3,494,297 | 2/1970 | Plasser et al. | 104/7 B |
| 3,685,456 | 8/1972 | Plasser et al. | 104/2 |
| 3,744,428 | 7/1973 | Plasser et al. | 104/7 R X |
| 4,066,020 | 1/1978 | Theurer | 104/7 B |

FOREIGN PATENT DOCUMENTS

| | | | |
|---|---|---|---|
| 1817894 | 5/1973 | Fed. Rep. of Germany | 104/7 B |

*Primary Examiner*—Randolph A. Reese
*Attorney, Agent, or Firm*—Kurt Kelman

[57] ABSTRACT

A mobile track surfacing machine comprises a machine frame unit comprising two machine frame parts linked together to form the unit. The machine frame parts have facing ends coupled together to permit the machine frame parts to pivot in relation to each other in a plane substantially parallel to the track and a single undercarriage supports each machine frame part for mobility on the track in the region of the machine frame part end opposite to the end linked to the other machine frame part. A track tamping unit is mounted on the rear machine frame part.

11 Claims, 3 Drawing Figures

MOBILE TRACK SURFACING MACHINE

Figures 1, 2, 3:
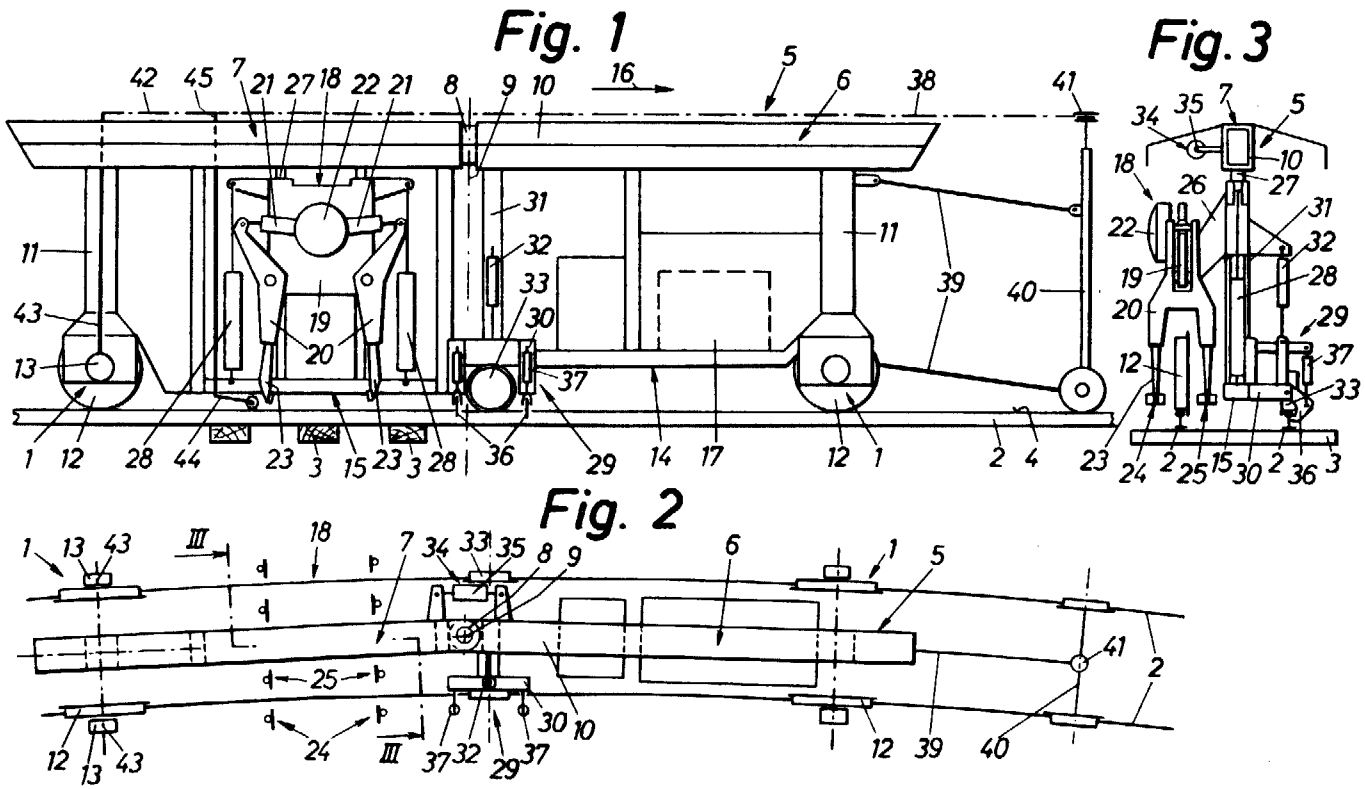

The present invention relates to a track surfacing machine mounted on a track including two rails supported on a plurality of ties for mobility in a working direction, and more particularly to a mobile track tamping machine adapted for use on narrow-gage tracks.

U.S. Pat. No. 3,494,297, dated Feb. 10, 1970, discloses a mobile track tamping machine for simultaneously tamping several ties which comprises a machine frame unit comprising two machine frame parts linked together to form the unit at respective ends of the machine frame parts facing each other. These facing machine frame part ends overhang the track section to be tamped and each overhanging machine frame part end carries a tamping unit. Coupling means links the facing machine frame part ends and is arranged to permit the machine frame parts to pivot in relation to each in a plane substantially parallel to the track about an axis substantially perpendicular to the track plane. Several, for instance four, successive ties may be tamped with such a machine simultaneously, which avoids the disadvantages inherent in the use of two single tampers operating in tandem. The use of such large tampers not only affords personnel and fuel economies but also facilitiates the proper positioning of the tamping tools in relation to the track because the pivoting of the machine frame parts enables the tamping tools to be accurately positioned and centered with respect to the ties to be tamped, despite the length of the machine frame unit. The arrangement of the tamping heads in the region of the central pivot of the machine frame unit is particularly advantageous when the machine operates in track curves because the tamping heads always are substantially in the line of the track and thus remain substantially symmetrically aligned with respect to the center line of the track even in track curves without the need for moving them laterally. This large machine is, however, rather expensive to build and maintain.

Another type of mobile track tamping machines provides a single rigid machine frame of substantial length whereon tamping means is mounted between two undercarriages supporting the machine frame for mobility on the track. At least one tamping head of the tamping means is mounted on the machine frame for lateral adjustment with respect thereto and the track so that the tamping tools may be laterally positioned for properly tamping the ties in track curves. This requires guides, drives and controls for the lateral movement of the tamping head on the machine frame.

It is the primary object of this invention to provide a mobile track surfacing machine which is simple, requires relatively little space and is particularly useful for work on curving narrow-gage tracks, such as are found in mountainous terrain.

This and other objects are accomplished in accordance with the invention with a machine frame unit which comprises two machine frame parts linked together to form the unit. Each machine frame part has two ends, respective ones of the machine frame part ends facing each other and coupling means links the facing machine part ends to permit the machine frame parts to pivot in relation to each other in a plane substantially parallel to the track. A single undercarriage supports each one of the machine frame parts for mobility on the track, the undercarriage of each machine frame part supporting the machine frame part in the region of the machine frame part end opposite to the one end. A ballast tamping unit is mounted only on the rear machine frame part, as seen in the working direction, by means of a carrier frame, if desired.

This modular machine frame unit consisting of linked frame unit modules adapts itself readily to curvatures in the track as it moves therealong since the modules or frame parts of the unit pivot with respect to each other for adjustment to the course of the track. In such a machine, the tamping head will always be properly centered in relation to the track rails, even in sharp curves, without requiring special lateral adjustment means. Despite the pivotal coupling means between the machine frame parts, i.e. the lateral self-adjustment of the frame parts as they move along the track, the machine frame unit may be sufficiently rigid and the arrangement and load distribution of the track tamping tool means and all other equipment supported on the machine frame unit may be such that an additional support in the region of the coupling means between the machine frame parts is not required. This not only simplifies the construction but also makes it possible to reduce the overall length of the machine. The modular machine frame unit constructed according to the present invention makes it possible to tamp one tie, or even two successive ties, during each tamping stage, as the machine advances intermittently from stage to stage, regardless of the curvature or superelevation of the track, and to work even in sharp curves without any part of the machine projecting into a neighboring track and thus interfering with traffic thereon.

The linked construction of the machine frame unit substantially reduces the lateral projection of any part of the machine frame in track curves, as compared to a rigid machine frame unit of the same length, so that the relatively small width available for accommodating the track surfacing equipment, particularly on narrow-gage tracks, may be used much more effectively. Special and expensive structures designed to reduce the width of such equipment, particularly tamping heads, may thus be avoided and available equipment of standard size may be used on such machines. This provides relatively inexpensive mobile track tampers for narrow-gage mountain tracks, mine tracks and curving tracks leading through tunnels, which afford very little space.

The above and other objects, advantages and features of the present invention will become more apparent from the following detailed description of a now preferred embodiment thereof, taking in conjunction with the accompanying schematic drawing wherein FIG. 1 is a side elevational view of a mobile track surfacing machine particularly adapted for use on narrow-gage tracks;

FIG. 2 is a schematically simplified top view of the machine, with the roof structures removed; and FIG. 3 is a transverse section along line III—III of FIG. 2.

Referring now to the drawing, there is shown a mobile track tamping, leveling and lining machine for narrow-gage tracks, such as mine tracks, which comprises a modularly linked machine frame unit 5 comprising two machine frame parts 6 and 7 linked together to form the unit. The machine frame parts each have two ends and respective ones of the machine frame part ends face each other. A coupling means illustrated as a pivotal connection 8 with a pivoting axis 9 extending substantially perpendicularly to the track plane links the facing machine frame part ends and is arranged to permit machine frame parts 6 and 7 to pivot in relation to each other in a plane substantially parallel to the track. A single undercarriage 1 supports each one of machine frame parts 6, 7 for mobility on track 4 which includes two rails 2 supported on a plurality of ties 3. A vertical support 11 is mounted at the region of the front and rear ends of the machine frame unit and connects the machine frame unit to the undercarriages which, in the illustrated embodiment, are constituted by a single wheeled axle 12, i.e. an axle mounted in journal boxes 13 and carrying a pair of wheels engaging the rails.

In accordance with an important preferred feature of this invention, each machine frame part is constituted by a beam-shaped frame extending substantially centrally between rails 2 of track 4 so that the machine frame unit is comprised of two-part main beam 10 extending substantially centrally between the track rails, each of undercarriages 1 supporting one end of the respective beam parts and comprising a single pair of wheels. This provides a very simple and readily accessible frame for the support of all types of track correction tool means, including tamping heads capable of tamping in straight track and in track switches, which makes the servicing of all the equipment very easy. It is particularly useful in machines designed for surfacing track in tunnels.

The illustrated machine frame unit with its main beam 10 comprises auxiliary carrier frames 14 and 15 mounted respectively on front machine frame part 6 and rear machine frame part 7, the designations "front" and "rear" throughout the specification and claims referring to the working direction of the machine, indicated by arrow 16. Carrier frame 14 on the front beam part, which extends substantially from front wheels 1 to pivotal link 8, 9 carries drive 17 as well as the fuel supply and drive control means for the machine frame unit. Carrier frame 15 on the rear beam part, which extends substantially from pivotal link 8, 9 to rear wheels 1, carries ballast tamping unit 18. Drive motor 17 is connected to front wheels 1 by a suitable transmission, for instance a hydromatic transmission, to provide a front-wheel drive for the machine and, if desired particularly for use underground, the drive may include exhaust gas purifying means.

This arrangement of the machine drive means in front of the pivotal connection between the two machine frame parts and the tamping head with all its drive and control means mounted rearwardly of the pivotal connection does not only have substantial advantages from the point of view of construction and interaction of the machine equipment along the length of the modular, linked multi-part machine frame unit but it also produces an advantageous load distribution over the two supporting undercarriages, making it possible to use single wheeled axles as undercarriages for most purposes, which makes the machines particularly useful in narrow-gage tracks permitting only relatively low axle pressures. However, this arrangement is also quite useful on main tracks of standard gage which permit the use of swivel trucks with two axles for support of the machine frame unit ends.

Tamping unit 18 is mounted vertically adjustably on auxiliary rear carrier frame 15. In the illustrated embodiment, the tamping unit comprises a tamping tool carrier 19 associated with each track rail 2, and a pair of reciprocable and vibratory tamping tools 20 mounted thereon for pivoting about a pivot intermediate their ends in a plane extending perpendicularly to the track plane and in the direction of the track. The upper ends of the tamping tools are connected to hydraulic reciprocating drives 21 which, in turn, are associated with a common and centrally positioned vibratory drive 22, for instance an eccenter shaft rotated by a hydraulic motor. The lower ends of the tamping tools are bifurcated and carry tamping jaws 23 arranged for immersion in the ballast on either side of rail 2 which tamping tool 20 straddles with its bifurcated end. As best shown in FIG. 3, the tamping jaws form pairs of tamping tools immersible to the left and to the right of each track rail for tamping the ballast under a tie 3 positioned between the tamping jaws of each pair 24, 25. A mobile track tamping machine with a central machine frame beam and a tamping tool arrangement of the illustrated type has been disclosed, for example, in my U.S. Pat. No. 4,066,020, dated Jan. 3, 1978.

Tamping tool carriers 19 associated with respective rails 2 are connected by crossbeam 26 and are vertically movable on vertical guide posts 27 by hydraulic drives 28. Each tie 3 is tamped by lowering the tamping tool carrier until tamping jaws 23 are immersed in the ballast below the tie, and actuating drives 21 and 22 to vibrate and squeeze together the eight tamping jaws along the longitudinal sides of the tie to compact the ballast therebetween and under the tie.

To enable the machine frame unit to follow the track during surfacing operations as well as when the machine is driven to a working site, it is useful to privide a guide wheel means on at least one of the facing machine frame part ends for guiding the modular machine frame unit along the rails of the track intermediate the two end undercarriages which support the machine frame unit for mobility on the track. This guide wheel means is preferably vertically retractably mounted on the one machine frame part end and has the function of guiding the pivotal center of the machine frame unit and its undercarriages in track curves when the machine drive is stopped and it is desired to adjust and fix the pivotal machine frame parts in a desired pivotal position in relation to each other.

In the illustrated embodiment of a tamping machine adapted also for leveling and lining the track, the track correction tool means of the machine comprises a track leveling and lining unit 29 including rail engaging rollers 33, and these lining rollers constitute the central guide wheel means for the modular machine frame unit. This double function of the lining rollers serving also as guide wheels further simplifies the structure and provides a compact construction helping to shorten the overall length of the machine. The illustrated track leveling and lining unit includes carrier frame 30 mounted for vertical movement on support post 31 arranged on front auxiliary carrier frame 14 at the end of the front machine frame part 6 facing rear macine frame part 7. Hydraulic drive 32 is connected to carrier frame 30 to enable unit 29 to be moved vertically for retracting rollers 33 when they are required neither for guidance or lining.

Drive 34 illustrated as a hydraulic motor 35 having respective ends linked to front and rear machine frame parts 6 and 7 enables the relative pivotal position of the two machine frame parts to be adjusted. When flanged rollers 33 are in engagement with track rails 2, actuation of drive 34 serves to impart a lining pressure on a respective one of the rollers for laterally moving one or the other track rail for lining the track. Drive 34 thus not only enables the two machine frame parts to be pivoted into a desired relative position and to be fixed in this position for proper centering of the track correction tool means but also to keep the two pivotal parts in straight alignment as a fixed unit when the machine is driven over long straight track sections.

Drive 34 is operated during a lining operation and may be deactivated during travel of the machine, for example, by interconnecting the two cylinder chambers of hydraulic motor 35 by a by-pass line, the cylinder chambers being separated by a double-acting piston.

Carrier frame 30 of track leveling and lining unit 29 also carries a pair of hook-shaped rail clamps 36 associated with each rail 2, the clamps being pivotal about an axis extending in the direction of track elongation and being connected to hydraulic drive 37 for engaging and disengaging the clamps. When the clamps are engaged with the rails, lifting of carrier frame 30 will raise the track in a leveling operation. The rail-engaging clamps 36 are so spaced from flanged rollers 33 and from each other that they enable the clamps properly to engage the rails even at abutting rail ends where the rail ends are interconnected by elongated rail fastening plates.

The illustrated track surfacing machine is particularly adapted for use on narrow-gage tracks, for instance tracks with a gage of 600 mm, and such tracks with sharp curves. Main beam 10 of the macine frame unit, which receives at least the major loads of the equipment carried by the machine, may be so sized as to be capable of sustaining these loads without appreciable deformation because of its central positioning between the track rails. When the central main beam is arranged in the range of the roof of the machine, the entire height of the machine can be fully utilized and the roof structure may be supported directly on the main beam.

As has been indicated hereinabove, the illustrated machine is also used to track leveling, for which purpose the track correction tool means with which the machine is equipped comprises the described track lifting unit. The illustrated reference system for controlling the track lifting unit comprises front bogie 40 mounted on rollers for mobility on the track and connected to front machine frame part 6 and a tensioned elongated element constituted by wire 38 extending substantially centrally between rails 2 of the track and having two ends. The front bogie is attached to the machine frame unit by spacing rods 39 and horizontally arranged pulley 41 is mounted on the front bogie and guides one end of wire 38 which is trained over the pulley. At the other end of tensioned element 38 the two wire ends are connected to track position sensing element 34 constituted by a vertical rod mounted on journal box 13 of the axle of rear undercarriage 1. A further rail position sensing element 44 also constituted by a vertical rod and riding on a roller is associated with each rail 2 in the region of tamping unit 18 and the upper ends 45 of the further track position sensing element are arranged to cooperate with tensioned wire 38 intermediate the ends thereof for controlling the track lifting unit. For this purpose, the upper ends 45 are constituted by switch plates which are raised together with the track rails on which they ride. When the switch plates contact reference wire 38, a control circuit is closed and an electric control pulse is generated and transmitted through the control circuit to a device which stops further operation of lifting cylinder 32 whereby the leveling operation is discontinued.

This relatively simple leveling system is particularly useful for the mobile track surfacing machine of this invention. Despite the modular construction of the multi-part frame unit and the pivotal relationship of the frame parts, the favorable ratio of the relatively long distance between the front and rear end points of the reference line and the short distance between the rear end point of the reference line and the intermediate rail position sensing point at the tamping station is maintained so that leveling errors are reduced to a minimum. Therefore, accurate leveling can be obtained with this machine operated by a single operator even without prior track measurements. Therefore, track surfacing operating costs are low, which is of particular importance on narrow-gage or branch tracks.

With the illustrated track leveling system, the track level is sensed at three points of each rail 2, i.e. in the region of rear undercarriage 1 where the track has previously been leveled and is in the corrected position, in the operating region of the tamping tools where the corrected track is fixed in position by tamping ballast under the raised tie, and in a forward track section which has not yet been corrected. When one-man operation is desired and no prior measurements are taken, the desired level is fixedly set on the front bogie by suitably adjusting the height of pulley 41 and any track level errors are then automatically corrected in the ratio of the length of wire chord 38 to the distance between sensing elements 43 and 44. If more accurate leveling is desired or required, previously determined grade levels are marked on each fifth to tenth tie. Wire guiding pulley 41 is then vertically adjusted on front bogie 40 in correspondence with the marked grade level. If the track level is higher than that desired at any tie, half of the error value is added or subtracted from the leveling parameter, depending on whether the reference wire is positioned higher or lower.

Although the track surfacing machine has been described and illustrated as a tamping machine, the same structural principles may be used to advantage in track surfacing machines equipped with different track correction tool means, such as ballast compacting machines, screwdriving machines and like machines whose track correction tools require the tools to be aligned with the track. Furthermore, the machine may be equipped with auxiliary devices used in track surfacing and maintenance work, such as special track lifting devices for operation in track switches and crossings, with track position measuring devices for determining the superelevation, and with various indicating instruments and control apparatus.

What is claimed is:

1. A track surfacing machine mounted on a track including two rails supported on a plurality of ties for mobility in a working direction, which comprises a macine frame unit comprising (a) two machine frame parts linked together to form the unit, each of the machine frame parts having two ends, respective ones of the machine frame part ends facing each other, (b) coupling means linking the facing machine frame part ends and arranged to permit the machine frame parts to pivot in relation to each other in a plane substantially parallel to the track, (c) a single undercarriage supporting each one of the machine frame parts for mobility on the track, the undercarriage of each machine frame part supporting the machine frame part in the region of the machine frame part end opposite the one end, and (d) the tamping tool means mounted only on the rear machine frame part, as seen in the working direction.

2. The track surfacing machine of claim 1, further comprising a tool means carrier frame mounting the tie tamping tool means on the rear machine frame part.

3. The track surfacing machine of claim 1, wherein each machine frame part is constituted by a beam-shaped frame extending substantially centrally between the rails of the track.

4. The track surfacing machine of claim 1, further comprising a guide wheel means mounted on at least one of the facing machine frame part ends for guiding the machine frame unit along the rails of the track intermediate the undercarriages.

5. The track surfacing machine of claim 4, wherein the guide wheel means is vertically retractably mounted on the one machine frame part end.

6. The track surfacing machine of claim 5, further comprising a track lining unit including rail engaging rollers, the rollers constituting the guide wheel means.

7. The track surfacing machine of claim 1, further comprising a drive for adjusting the relative pivotal position of the two machine frame parts.

8. The track surfacing machine of claim 7, wherein the drive is a hydraulic motor.

9. The track surfacing machine of claim 1, further comprising a drive for the machine frame unit mounted thereon in front of the coupling means, as seen in the working direction.

10. The track surfacing machine of claim 1, wherein the machine frame unit is comprised of a main beam extending substantially centrally between the rails of the track and consisting of two parts constituting the machine frame parts, each undercarriage comprising a single pair of wheels, and an auxiliary carrier frame mounted on each beam part, the carrier frame on the rear beam part, as seen in the working direction, carrying a ballast tamping unit constituting the tie tamping tool means, and the carrier frame on the front beam part, as seen in the working direction, carrying a drive and drive control means for the machine frame unit.

11. The track surfacing machine of claim 1, further comprising a track lifting unit, a reference system for controlling the track lifting unit, a front bogie mounted for mobility on the track and connected to the front machine frame part, as seen in the working direction, the reference system including a tensioned elongated element extending substantially centrally between the rails of the track and having two ends, a pulley mounted on the front bogie and guiding one of the ends of the tensioned elongated element, the undercarriage supporting the end of the rear machine frame part, as seen in the working direction, being constituted by a single wheeled axle, a track position sensing element mounted on the axle, the other end of the tensioned elongated element being connected to the sensing element, and a further rail position sensing element mounted on the rear machine frame part in the region of the tamping unit, the further rail position sensing element cooperating with the tensioned elongated element intermediate the ends thereof for controlling the track lifting unit.

* * * * *